United States Patent [19]

McGee, Jr.

[11] Patent Number: 4,684,569

[45] Date of Patent: Aug. 4, 1987

[54] REINFORCED V-BELT CONTAINING FIBER-LOADED NON-WOVEN FABRIC AND METHOD FOR PRODUCING SAME

[75] Inventor: James N. McGee, Jr., Pleasant Garden, N.C.

[73] Assignee: Burlington Industries, Inc., Greensboro, N.C.

[21] Appl. No.: 859,435

[22] Filed: May 5, 1986

Related U.S. Application Data

[63] Continuation-in-part of Ser. No. 484,367, Apr. 12, 1983, Pat. No. 4,598,013.

[51] Int. Cl.[4] ..... B32B 27/00

[52] U.S. Cl. ..... 428/286; 428/290; 428/293; 428/295; 428/287

[58] Field of Search ..... 428/224, 289, 290, 284, 428/286, 287, 292, 293, 294, 295, 300, 301, 107, 113, 291; 427/407.1, 412

[56] References Cited

U.S. PATENT DOCUMENTS

| | | | |
|---|---|---|---|
| 3,620,897 | 11/1971 | Tanimoto | 427/370 |
| 3,998,986 | 12/1976 | Williams | 428/300 |
| 4,154,335 | 5/1979 | Burnett et al. | 428/300 |

*Primary Examiner*—Lorraine T. Kendell
*Attorney, Agent, or Firm*—Nixon & Vanderhye

[57] ABSTRACT

A reinforced V-belt and method relating to same in which the V-belt comprises bottom, middle and top portions, the bottom portion consisting of a layer of bias cushion fabric and one or more layers of a seamless "fiber-loaded" non-woven fabric which has been impregnated with first and second solvent solutions and a plurality of chopped or staple length fibers generally oriented in the cross-machine direction relative to the longitudinal axis of the non-woven fabric; the middle portion consists of rubberized cord and a layer of non-woven fabric disposed on top of the rubberized cord; the top portion consists of bias cushion fabric.

7 Claims, 3 Drawing Figures

REINFORCED V-BELT CONTAINING FIBER-LOADED NON-WOVEN FABRIC AND METHOD FOR PRODUCING SAME

RELATED APPLICATIONS

This application is a continuation-in-part application of Ser. No. 484,367, filed Apr. 12, 1983. now issued as U.S. Pat. No. 4,598,013.

BACKGROUND OF THE PRESENT INVENTION

The present invention relates to reinforcing materials used in flexible "V"-type belts and the methods for producing same. More particularly, the invention relates to a V-belt construction having, as one component thereof, a fiber-loaded seamless industrial fabric produced from the treatment of a non-woven fabric, whereby the fabric has a high percentage of either "chopped" or "staple length" fibers oriented in the "cross-machine" (fill) direction. i.e., perpendicular to the non-woven fabric length.

Conventional raw edge V-belts produced from fabrics containing chopped fibers, as well as large "full-wrapped" V-belts, are typically manufactured by combining the chopped fibers with a rubber compound, milling and then calendering the resultant mixture to form fiber-loaded sheets which are used to form the inside portion of the belt—that is, the portion which undergoes considerable stress (both axially and longitudinally) during normal use in, for example, high speed pulley arrangements. Almost all conventional V-belts also utilize one form or another of a strength member incorporated in the body of the belt.

It has long been known that the addition of chopped fiber adds stability widthwise and allows the belt to flex and elongate in the lengthwise direction. Known chopped fiber constructions are also intended to hold the belt in a "V" shape, and to thereby reduce abrasion at the contact points between the belt and any associated pulleys or other friction surfaces.

A critical limitation of conventional prior art V-belt constructions is that the equipment used to compound and calender the rubber/fiber mixtures are not generally capable of forming sheets having a chopped fiber concentration of over 10% by weight. Although it is known that a rubber to fiber ratio of over 25% would considerably improve belt stability and increase belt life, the conventional compounding methods have not been capable of achieving such a high percentage of fiber concentration.

In addition, conventional compounding methods are not capable of orienting the fibers in the cross-machine direction in sufficiently high concentrations to avoid cutting and splicing the fiber-loaded sheets. For example, a known method used by V-belt manufacturers to compound rubber and thereafter orient chopped fibers in a widthwise direction includes the following basic steps. First, the chopped fibers (approximately ¼ inch in length) are added to a base rubber composition with additional mixing to break the fibers into individual components. The composition is then processed on a rubber mill and "slabbed" (generally in ½ inch thick sheets) which are then calendered to sheets approximately 60 inches wide and 0.060 inches thick. The calendering step orients 60% to 80% of the chopped fibers in the lengthwise direction of each sheet. The 60 inch sheets are then cut to 41 inch lengths and combined by splicing individual sections crosswise to form a continuous roll (generally 41 inches wide) for belt makeup purposes. This step is necessary in order for 80% of the fibers to be oriented in the crosswise direction relative to the longitudinal axis of the finished V-belt.

Likewise, a known method for manufacturing "full-wrapped" V-belts consists of the following steps. First, a layer of cushion fabric, commonly referred to as a "bias fabric", is placed on the belt makeup drum followed by layers of a fiber-loaded sheet previously calendered (as described above) to a specified thickness. A continuous strength element (generally consisting of one or more rubberized cord fabrics) is placed on top of the calendered sheets, followed by a rubberized laminate fabric. The V-belt is then slit to the desired size and shape and "wrapped" with a bias fabric (generally 45° or more) by one ore more complete wraps. The bias fabric overlaps on the underside of the narrow portion of the V-belt and the resultant "wrapped" construction is then cured in a conventional oven at a temperature and for a period of time sufficient to vulcanize the rubber components, thereby forming a cohesive structure.

Although conventional prior art V-belt constructions are acceptable for most moderate stress applications, they suffer from having a limited amount of chopped fiber within the base rubber compound and a lack of fiber orientation in the cross-machine (widthwise) direction. V-belts having a high percentage (i.e. greater than 10%) of fiber in the widthwise direction are, in fact, very difficult to manufacture because of the natural tendency of the fibers to become oriented in a lengthwise direction (relative to the longitudinal axis of the belt) during milling or calendering operations. Such limitations reduce overall belt stability and life span, particularly in high stress applications. In addition, conventional prior art V-belt constructions are relatively expensive, particularly in the larger sizes, due to the additional cutting and splicing steps required to achieve a higher percentage of fibers in the cross-machine direction.

Thus, it is an object of the present invention to provide an improved V-belt construction having a higher percentage of stability-improving fibers (i.e. more than 10 percent) incorporated into the belt in an oriented manner to provide sufficient flexibility in the lengthwise direction, but good stability widthwise.

It is a further object of the present invention to provide for a method of manufacturing a "seamless" V-belt reinforcing fabric having a higher percentage of stability-improving fibers oriented in a crosswise direction.

It is still a further object of the present invention to provide a simplified and improved V-belt having high flexibility but greater stability and a longer life-span than conventional constructions.

These and other objects of the invention will become evident from the detailed description, drawings and appended claims.

It has now been found that the foregoing objects regarding overall strength, utility and life-span of V-belts can be accomplished by a unique construction whereby a seamless, i.e., endless and non-spliced, fabric is produced from a non-woven fabric having an increased percentage of either chopped or "staple length" fibers oriented perpendicular to the non-woven fabric length. More particularly, it has now been found that the application of solvent and rubber compositions to the non-woven fabric by way of an initial impregnation and a "re-impregnation" of the fabric, followed by an expansion of the fabric, permits the fibers to be reoriented in the crosswise direction while in a "solvated state" during a subsequent tentering operation. Thus, exemplary V-belt constructions in accordance with the present invention contain a higher percentage of stability-improving fibers incorporated into the belt in an oriented manner to thereby provide sufficient flexibility in the lengthwise direction, but good stability widthwise. It has also been found that both conventional "chopped" fibers (usually about ¼ inch in length) and "staple length" fibers may be used in fiber-loaded non-woven fabrics and V-belt constructions according to the invention.

The staple length fibers may be from ¼ inch to 6 inches, preferably 1 inch to 1⅛ inches.

The fibers may be cotton, polyester, nylon, nomex, kevlor, rayon or blends of two or more of these fibers.

DETAILED DESCRIPTION OF THE INVENTION

Figure 1:
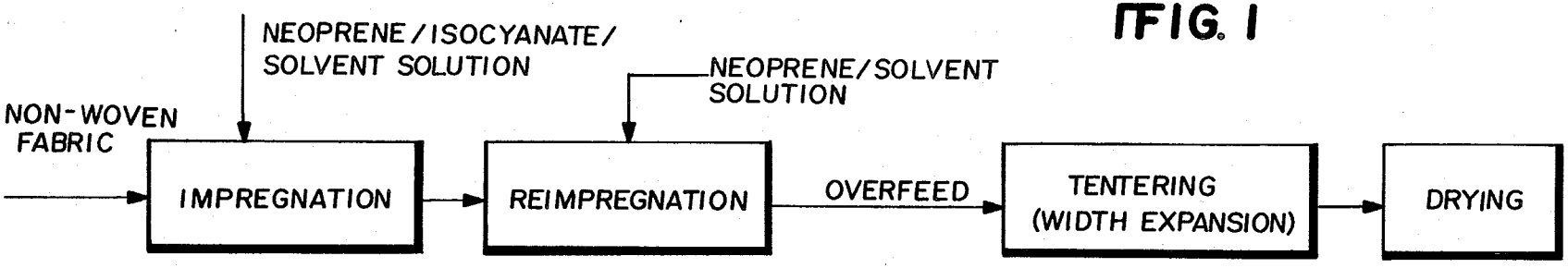
FIG. 1 is a block-flow diagram depicting the basic process steps for producing the fiber-loaded non-woven fabric according to the present invention.

In accordance with the foregoing objects, a preferred form of the process for producing the fiber-loaded non-woven fabric according to the invention involves the following basic steps: (1) entangling the chopped or staple length fibers in a non-woven fabric by way of a conventional needle punch; (2) impregnating the non-woven fabric with a neoprene/organic solvent/isocyanate composition; (3) reimpregnating the fabric with a neoprene/organic solvent composition; (4) drawing the impregnated non-woven fabric on a tentering frame; and (5) drying the fabric in a conventional oven. The product so produced can then be layered to form a V-belt construction of desired size and length. A specific illustration of a V-belt constructed in accordance with the invention is set forth in Example 1 below.

EXAMPLE 1

A "cut edge" V-belt was produced by using a starting material of 100% polyester fabric, non-woven greige Style No. 75051, at 4.79 ounces per square yard. The non-woven fabric was needle-punched using a conventional needle punch in order to "entangle" the chopped fibers in the fabric matrix.

Thereafter, in order to "reorient" the fibers in the 75051 greige sample in accordance with the invention, the fabric was first impregnated with a mixture of 20% (by weight) neoprene rubber compound, 5% isocyanate and 70% solvent (toluene), by dipping it in the impregnating solution and passing the fabric through a set of rollers to remove any excess composition. The percentage of wet pickup following the initial impregnation was found to be approximately 60%. The fabric was then passed through a conventional textile applicator and reimpregnated with a compounded mixture comprised of neoprene rubber and 58% solvent (toluene), wherein the non-woven fabric was coated on both sides. The fabric was then overfed onto tenter frame pins at 40% over frame pin chain speed and the width of the fabric expanded from a 60 inch greige width to 86.5 inches (approximately 44% increase in width). Finally, the fabric was dried in a conventional oven for approximately 5 minutes at 150° F. The drying operation was done only for a period of time sufficient to remove any excess solvent (water in an aqueous systems). That is, the drying must be short enough to avoid any vulcanization of the rubber compounds. In this regard, it has been found that a solvent-based system (as described above) requires approximately 5 minutes of drying in a conventional oven at 150° F.; aqueous systems generally require 5 minutes at 250° F.

The V-belt construction produced in accordance with the foregoing example was then tested using known analytical techniques, with the following results:

| | Greige | Finished Uncured | Cured |
|---|---|---|---|
| Grab Tensile: | | | |
| Machine Direction | 50 Lbs. | 80 Lbs. | 138 Lbs. |
| Cross Machine direction | 45 Lbs. | 155 Lbs. | 225 Lbs. |
| Weight/Square Yard: | 4.79 oz. | 38.42 oz. | 38.42 oz. |
| Adhesion Pounds per inch: | | | |
| Fabric/Fabric | — | — | 37 Lbs. |
| Fabric/.050 Neoprene/ Fabric | — | — | 52 Lbs. Fabric Break |
| Elongation: | | | |
| Machine direction (Warp) | | | |
| 20-Lb. Load | | 29.9% | 9.99% |
| 30-Lb. Load | | 76.6% | 23.30% |
| 40-Lb. Load | | — | 36.60% |
| Cross Machine direction (Fill) | | | |
| 20-Lb. Load | | 3.33% | 1.66% |
| 30-Lb. Load | | 6.66% | 4.90% |
| 40-Lb. Load | | 13.30% | 6.66% |
| Width: | 60 in. | 86.5 in. | — |
| Gauge: | .020 | .060 | .040 |
| Percent Rubber Add-on: | | 702% | 702% |
| Ratio Fiber to Rubber: | | 12.47% Fiber; 87.53% Rubber | |

At the time in which the non-woven fabric is overfed (relative to the frame pin chain speed) and its width expanded, the fibers are in a "solvated" state and become reoriented with a high percentage (approximately 70–100%) in the cross-machine direction. Thus, the wet coating acts as a lubricant which allows the fibers to move freely within the fabric matrix while they are in the solvated state. The net effect of such reorientation is shown by the test results of the finished fabric tensile strength and elongation. That is, the machine direction grab tensile strength increased approximately 60% over the untreated greige fabric, while the cross-machine direction tensile strength increased approximately 244%.

Thus, as those skilled in the art can readily appreciate, non-woven "reoriented" fabric constructions in accordance with the invention have extremely high elongation in the machine direction but very low elongation in the cross-machine direction thereby resulting in excellent flexibility in the lengthwise direction of a finished V-belt, but good stability widthwise. In this regard, it has been found that the high flexibility and strength characteristics are achieved when the width is expanded in the range of 20 to 60%. The elongation of the fabric is also high enough to prevent any interference with strength members (such as rubberized cords) that are incorporated in a typical construction.

With particular reference to FIG. 1 of the drawings, FIG. 1 depicts a block-flow diagram of the basic process steps for producing fiber-loaded non-woven fabrics according to the invention. A preferred embodiment utilizes a non-woven polyester starting material that has been subjected to a conventional needle punch operation to incorporate and "entangle" the chopped fibers within the fabric matrix. As indicated above, both conventional "chopped" fibers (usually about $\frac{1}{4}$ inch in length) and staple length fibers may be used to form the fiber-loaded fabrics and V-belt constructions in accordance with the invention. The staple length fibers may be standard polyester/cotton fibers ranging in size from $\frac{1}{2}$ inch to $1\frac{1}{2}$ inches, within a preferred length of about 1 inch to $1\frac{1}{8}$ inches.

The "punched" fabric is then subjected to a first impregnation with a neoprene/isocyanate/solvent solution by immersing (dipping) the fabric into the solution. It is then reimpregnated on both sides with a Neoprene/solvent composition using a standard textile pad. The two impregnation steps place the chopped or staple length fibers in a "solvated", i.e. mobile, state within the fabric structure. The impregnated fabric is then overfed to a tentering frame where it is stretched and extended in a widthwise direction in order to reorient the fibers in the cross-machine direction. Finally, the "reoriented" fabric is dried in a conventional oven to remove any excess solvent.

Figure 2:
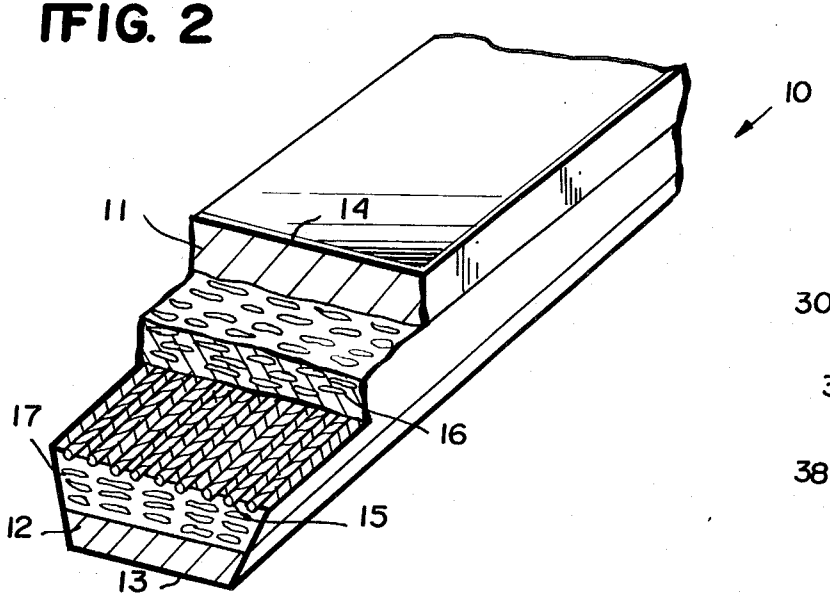
FIG. 2 is a perspective view, taken in cross-section, of a "cut edge" V-belt construction in accordance with the invention.

With particular reference to FIG. 2, an exemplary cut edge V-belt construction in accordance with the present invention is shown generally at 10. The narrow bottom portion of the V-belt (shown generally at 13) is comprised of a first layer consisting of a bias cushion fabric 12, followed by one or more layers of a fiber-loaded non-woven polyester fabric 17 having its fibers "reoriented" in accordance with the present invention. A continuous strength rubberized cord, shown as 15 on FIG. 2, is placed on top of the fiber-loaded non-woven fabric, followed by a second layer of "reoriented" fabric 16. Finally, a second layer of bias cushion fabric 11 forms the top portion of the V-belt and defines edge 14.

Figure 3:
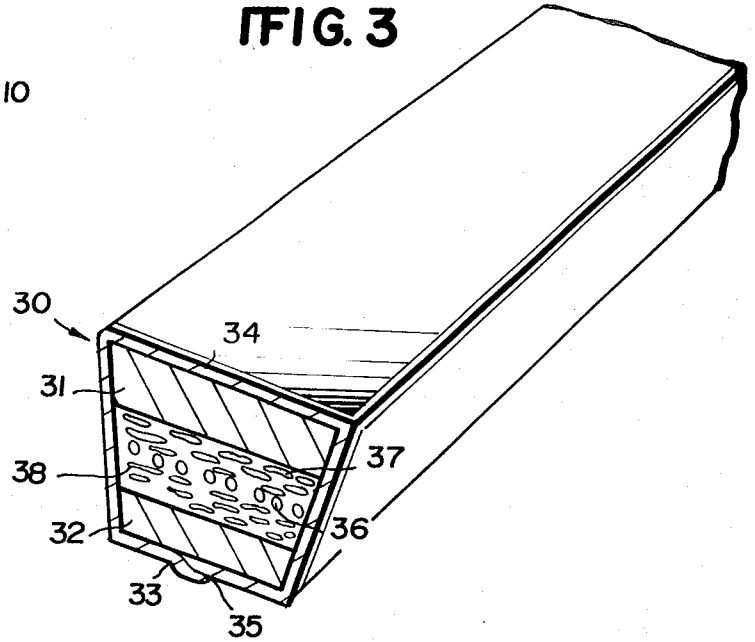
FIG. 3 is a perspective view, also taken in cross-section, of a "full wrapped" V-belt construction in accordance with the invention.

With particular reference to FIG. 3, an exemplary "full wrapped" V-belt utilizing a "reoriented" fiber-loaded fabric in accordance with the invention is shown generally at 30. Again, a bottom layer comprised of bias cushion fabric (shown at 32) forms the bottom portion of the belt, followed by reoriented fiber-loaded material 38 and a strength element in the form of a rubberized cord 36. A second layer of fiber-loaded material 37 is added on top of the strength element together with a second bias cushion fabric 31. The entire V-belt is then "wrapped" with a second bias fabric 33 by way of one or more complete wraps. As FIG. 3 makes clear, bias fabric 33 overlaps the underside of the narrow portion of the V-belt at 35. Once the belt is fully wrapped, the entire construction is cured in a conventional oven at a temperature and period of time sufficient to accomplish vulcanization.

The "reoriented" fabric products according to the present invention can be produced by using either a solvent rubber solution or an aqueous latex-resin solution as the impregnating solvent. Although neoprene is the preferred polymer, blends of the various generic types of neoprene may be employed. An example of one such blend of natural rubber with a neoprene polymer is shown below as merely one or many available recipes for producing a seamless "reoriented" fabric in accordance with the invention.

| | Preferred Composition | Composition Range |
|---|---|---|
| Neoprene GNA | 90 | 0–100 |
| Neoprene GRT | — | 0–100 |
| #1 Smoke Sheet | 10 | 0–30 |
| Scorchguard "0" | 3.5 | 3–5 |
| Antixodant 2246 | 1.0 | 1–3 |
| Naugha White | 1.5 | 1–3 |
| Stearic Acid | 0.5 | 0–2 |
| Plasticizer 4141 | 12.5 | 5–20 |
| N-220 | 30 | 15–60 |
| N-774 | 30 | 15–60 |
| ZNO | 4.5 | 3–5 |
| MBTS | 1.2 | 0–3 |

Other polymers that are useful as the major portion of the compound include polyurethane, Buna-N, Hypalon, natural rubber, EPDM and mixtures of such polymers (up to 30%) blended with neoprene rubber. The end products produced from such compositions may range in fiber to rubber concentration of 5% fiber/95% rubber to 95% fiber/5% rubber. Thus, the non-woven fabric weights can be adjusted for various fiber/rubber ratios to obtain a desired finished gauge thickness.

It has also been found that the fiber-loaded (reoriented) non-woven fabrics in accordance with the invention can be made from either virgin or reclaimed natural or man-made blends of different fibers. Further, the width of the expanded non-woven fabric over greige may be as high as 70% to ensure that a higher percentage of the fibers will be properly oriented. As indicated above, because the process according to the invention orients the fiber in the cross-machine direction (contrary to the conventional processes) it avoids the step of orienting the fibers by cutting, turning and splicing the fiber-loaded fabric. In addition, the fact that the belt is seamless avoids any weight variations in the V-belt which tend to cause "belt slapping" and/or reduced wear due to improper belt balance. The process according to the invention thus allows the manufacturer to produce a V-belt having improved balance by using a seamless raw material that can be applied in any number of layers without fear of weight variations in the finished product.

While the invention herein is described in what is presently believed to be a practical, preferred embodiment thereof, it will be apparent that many modifications may be made within the scope of the invention, which scope is to be accorded the broadest interpretation of the appended claims so as to encompass all equivalent methods, fabrics and V-belt constructions.

What is claimed is:

1. A reinforced V-belt having bottom, middle and top portions thereof, said bottom portion comprising a layer of bias cushion fabric and one or more layers of a fiber-loaded non-woven fabric wherein at least 70% of the fibers in said non-woven fabric are oriented generally perpendicular to the longitudinal axis of said non-woven fabric, said middle portion comprising a rubberized cord and a layer of said fiber-loaded non-woven fabric disposed on top of said rubberized cord, and said top portion comprising bias cushion fabric, said fiber-loaded non-woven fabric having first and second solutions impregnated therein.

2. A reinforced V-belt according to claim 1, wherein said first solvent solution comprises one or more rubber compounds, an isocyanate compound and an organic solvent.

3. A reinforced V-belt according to claim 1, wherein said second solvent solution comprises one or more rubber compounds and an organic solvent.

4. A reinforced V-belt according to claim 1, wherein said first and said second solvent solutions comprise an aqueous latex-resin.

5. A reinforced V-belt according to claim 3, wherein said rubber compounds are taken from the group consisting essentially of neoprene, polyurethane, Buna-N, Hypalon and natural rubber, and wherein said organic solvent is toluene.

6. A reinforced V-belt according to claim 1, wherein said fibers are chopped polyester fibers approximately $\frac{1}{4}$ inch in length.

7. A reinforced V-belt according to claim 1, wherein said fibers are staple length cotton or polyester fibers ranging in length from $\frac{1}{4}$ inch to 6 inches.

* * * * *